US005501579A

United States Patent [19]

Kimura et al.

[11] Patent Number: 5,501,579

[45] Date of Patent: * Mar. 26, 1996

[54] AXIAL MULTI-PISTON COMPRESSOR HAVING ROTARY VALVE FOR ALLOWING RESIDUAL PART OF COMPRESSED FLUID TO ESCAPE

[75] Inventors: Kazuya Kimura; Chuichi Kawamura; Masafumi Ito; Yoshihiro Makino, all of Kariya, Japan

[73] Assignee: Kabushiki Kaisha Toyoda Jidoshokki Seisakusho, Aichi, Japan

[ * ] Notice: The portion of the term of this patent subsequent to Jan. 31, 2012, has been disclaimed.

[21] Appl. No.: 132,116

[22] Filed: Oct. 5, 1993

[30] Foreign Application Priority Data

Oct. 5, 1992 [JP] Japan ..... 4-266190

[51] Int. Cl.[6] ..... F04B 1/12

[52] U.S. Cl. ..... 417/269; 91/480; 91/499; 137/312; 137/625.11

[58] Field of Search ..... 417/269 O, 516, 417/532, 539, 222.1, 222.2; 91/480, 484, 499; 137/312, 625.11, 625.47

[56] References Cited

U.S. PATENT DOCUMENTS 1,367,914 2/1921 Larsson .

5,232,349 8/1993 Kimura et al. ..... 417/222.1

*Primary Examiner*—Richard A. Bertsch
*Assistant Examiner*—William Wicker
*Attorney, Agent, or Firm*—Burgess, Ryan and Wayne

[57] ABSTRACT

An axial multi-piston compressor includes a drive shaft, a cylinder block having cylinder bores formed therein and surrounding the drive shaft, and a plurality of pistons slidably received in the respective cylinder bores, wherein the pistons are successively reciprocated in the cylinder bores by a rotation of the drive shaft so that a suction stroke and a discharge stroke are alternately executed in each of the cylinder bores. During the suction stroke, a fluid is introduced into the cylinder bore, and during the compression stroke, the introduced fluid is compressed and discharged from the cylinder bore such that a residual part of the compressed fluid is inevitably left in the cylinder bore when the compression stroke is finished. The compressor further includes a rotary valve for allowing the residual part of the compressed fluid to escape from the cylinder bore into another cylinder bore after the suction stroke is executed in the former cylinder bore over a given short period of time.

5 Claims, 6 Drawing Sheets

AXIAL MULTI-PISTON COMPRESSOR HAVING ROTARY VALVE FOR ALLOWING RESIDUAL PART OF COMPRESSED FLUID TO ESCAPE

BACKGROUND OF THE INVENTION

1. Field of the Invention

The present invention relates to an axial multi-piston compressor comprising a drive shaft, a cylinder block having cylinder bores formed therein and surrounding the drive shaft, and a plurality of pistons slidably received in the cylinder bores, respectively, wherein the pistons are successively reciprocated in the cylinder bores by a rotation of the drive shaft so that a suction stroke and a discharge stroke are alternately executed in each of the cylinder bores.

2. Description of the Related Art

Japanese Unexamined Patent Publication (Kokai) No. 59(1984)-145378 discloses a swash plate type compressor as representative of an axial multi-piston compressor, which may be incorporated in an air-conditioning system used in a vehicle such as an automobile. This swash plate type compressor comprises: front and rear cylinder blocks axially combined to form a swash plate chamber therebetween, the combined cylinder blocks having a same number of cylinder bores radially formed therein and arranged with respect to the central axis thereof, the cylinder bores of the front cylinder block being aligned and registered with the cylinder bores of the rear cylinder block, respectively, with the swash plate chamber intervening therebetween; double-headed pistons slidably received in the pairs of aligned cylinder bores, respectively; front and rear housings fixed to front and rear end faces of the combined cylinder blocks through the intermediary of front and rear valve plate assemblies, respectively, the front and rear housings each forming a suction chamber and a discharge chamber together with the corresponding one of the front and rear valve plate assemblies; a rotatable drive shaft arranged so as to be axially extended through the front housing and the combined cylinder blocks; and a swash plate securely mounted on the drive shaft within the swash plate chamber and engaging with the double-headed pistons to cause these pistons to be reciprocated in the pairs of aligned cylinder bores, respectively, by the rotation of the swash plate.

The front and rear valve plate assemblies in particular have substantially the same construction, in that each comprises: a disc-like member having sets of a suction port and a discharge port each set being able to communicate with the corresponding one of the cylinder bores of the front or rear cylinder block; an inner valve sheet attached to the inner side surface of the disc-like member and having suction reed valve elements formed integrally therein, each of which is arranged so as to open and close the corresponding suction port of the disc-like member; and an outer valve sheet attached to the outer side surface of the disc-like member and having discharge reed valve elements formed integrally therein, each of which is arranged so as to open and close the corresponding discharge port of the disc-like member. Each of the front and rear valve plate assemblies is also provided with suction openings aligned with passages formed in the front or rear cylinder block, respectively, whereby the suction chambers formed by the front and rear housings are in communication with the swash plate chamber into which a fluid or refrigerant is introduced from an evaporator of an air-conditioning system, through a suitable inlet port formed in the combined cylinder blocks.

In the swash plate type compressor as mentioned above, the drive shaft is driven by the engine of a vehicle, such as an automobile, so that the swash plate is rotated within the swash plate chamber, and the rotational movement of the swash plate causes the double-headed pistons to be reciprocated in the pairs of aligned cylinder bores. When each piston is reciprocated in the aligned cylinder bores, a suction stroke is executed in one of the aligned cylinder bores and a compression stroke is executed in the other cylinder bore. During the suction stroke, the suction reed valve element is opened and the discharge reed valve element is closed, whereby the refrigerant is delivered from the suction chamber to the cylinder bore through the suction port. During the compression stroke, the suction reed valve element concerned is closed and the discharge reed valve element concerned is opened, whereby the delivered refrigerant is compressed and discharged from the cylinder bore into the discharge chamber, through the discharge reed valve element.

In this type compressor, the refrigerant includes a lubricating oil mist, and the movable parts of the compressor are lubricated with the oil mist during the operation. Also, the oil mist appears on the suction and discharge reed valve elements, and serves as a liquid-phase seal when each of the reed valve elements is closed.

When the compression stroke is finished in each of the cylinder bores, the corresponding discharge reed valve element is closed. At this point of time, a small part of the compressed refrigerant is inevitably left in a fine space defined between the piston head and the valve plate assembly and in the discharge port formed in the valve plate assembly, and the corresponding suction reed valve element is adhered to the valve seat thereof with the liquid-phase oil. Accordingly, just after the suction stroke is initiated, i.e., just after the corresponding head of the double-headed piston is moved from top dead center toward bottom dead center, the suction reed valve element cannot be immediately opened, i.e., the refrigerant cannot be immediately introduced from the suction chamber into the cylinder bore through the suction reed valve element, because the residual part of the compressed refrigerant has a higher pressure than that of suction chamber, and because and the adhesion force and resilient force of the suction reed valve must be overcome before the refrigerant can be introduced from the suction chamber to the cylinder bore through the suction port. Namely, at the beginning of the suction stroke, the residual part of the compressed refrigerant is merely expanded in the cylinder bore, and thus the introduction of the refrigerant from the suction chamber into the cylinder bore cannot take place until a differential between the pressures in the cylinder bore and the suction chamber exceeds a certain level.

Therefore, in the compressor as mentioned above, a practical suction volume of the refrigerant, which can be obtained during the suction stroke, is lower than a theoretical suction volume of the refrigerant due to the residual part of the compressed refrigerant, and thus it is impossible to sufficiently realize a theoretical performance from the compressor.

Japanese Unexamined Patent Publication (Kokai) No. 5(1993)-71467, corresponding to U.S. Pat. No. 5,232,349 issued on Aug. 3, 1993, discloses an axial multi-piston compressor constituted such that a theoretical suction volume of the refrigerant can be substantially obtained during the suction stroke. In this compressor, the suction reed valves are substituted for a single suction rotary valve slidably disposed in a central circular space formed in the cylinder block and joined to the drive shaft for rotation thereof. Namely, the valve plate assembly is provided with only the discharge reed valve elements and the discharge ports, and the suction reed valve elements and the suction ports are eliminated therefrom. The suction rotary valve is provided with an arcuate groove formed in a peripheral surface thereof, and the arcuate groove is in communication with the suction chamber. The suction rotary valve is further provided with a through passage extending diametrically therethrough. On the other hand, the cylinder block is provided with radial passages formed therein, and each of these radial passages is in communication with the corresponding cylinder bore at an end face thereof on which the discharge port is disposed. The inner ends of the radial passages are opened at an inner wall face of the central circular space of the cylinder block in which the suction rotary valve is slidably received.

In the compressor as disclosed in JUPP (Kokai) No. 5(1993)-71467 (U.S. Pat. No. 5,232,349), when the suction stroke is executed in each of the cylinder bores, the cylinder bore concerned is communicated with the suction chamber through the radial passage thereof and the arcuate groove of the suction rotary valve, so that the refrigerant is introduced thereinto. During the suction stroke, the communication is maintained between the cylinder bore and the suction chamber due to a given arcuate length of the arcuate groove. When the suction stroke is finished, i.e., when the piston reaches bottom dead center, the communication between the cylinder bore and the suction chamber is cut off. Then, the compression stroke is initiated, so that the piston stroke is moved from bottom dead center toward top dead center. When the compression stroke is finished, i.e., when the piston reaches top dead center, a part of the compressed refrigerant is inevitably left in a small volume of the cylinder bore defined by the piston head and the valve plate assembly, similar to the compressor as disclosed in JUPP (Kokai) No. 59(1984)- 145378. However, just after the compression stroke is finished, i.e., just after the piston is moved from top dead center toward bottom dead center, the cylinder bore concerned is communicated with the diametrically opposed cylinder bore, in which the suction stroke is just finished, through the diametrical through passage formed in the rotary valve, and thus the residual part of the compressed refrigerant escapes from the cylinder bore concerned to the diametrically opposed cylinder bore not governed by the compression stroke. Accordingly, as soon as the cylinder bore concerned is made to communicate with the suction chamber through the radial passage thereof and the arcuate groove of the rotary valve, the refrigerant is introduced from the suction chamber the cylinder bore concerned, due to the escape of the residual part of the compressed refrigerant. As a result, a practical suction volume of the refrigerant, which can be obtained during the suction stroke, is substantially equal to a theoretical suction volume of the refrigerant, and thus it is possible to substantially realize a theoretical performance from the compressor.

Nevertheless, in the compressor as disclosed in U.S. Pat. No. 5,232,349, a drive force for moving the piston from top dead center toward bottom dead center becomes larger in comparison with the compressor as disclosed in JUPP No. (Kokai) No. 59(1984)-145378, because the residual part of the compressed refrigerant escapes just after the compression stroke is finished. Namely, existence of the residual part of the compressed refrigerant results in a decrease in the suction volume of the refrigerant, but it contributes to reduction of the drive force for moving the piston from top dead center toward bottom dead center. Accordingly, although a compression performance of the compressor disclosed in U.S. Pat. No. 5,232,349 can be substantially improved, it exhibits a drive efficiency inferior to that of the compressor as disclosed in JUPP No. (Kokai) No. 59(1984)-145378.

Also, the compressor shown in U.S. Pat. No. 5,232,349 involves a problem to be solved. In particular, when the residual part of the compressed refrigerant escapes from the cylinder bore concerned to the diametrically opposed cylinder bore not governed by the compression stroke, a pressure of the escaped part of refrigerant is substantially lowered to a low pressure level in the suction chamber. Thus, the pressure of the escape part of refrigerant must be again raised during the compression stroke. Of course, this results in a great loss in an efficiency of compression in the compressor.

SUMMARY OF THE INVENTION

Therefore, an object of the present invention is to provide an axial multi-piston compressor constituted such that a residual part of the compressed fluid escapes from the cylinder bore to bring a practical suction volume of the fluid close to a theoretical suction volume as much as possible, without substantially deteriorating drive efficiency thereof.

Another object of the present invention is to provide an axial multi-piston compressor as mentioned above, which is constituted in such a manner that the residual part of the compressed fluid can escape from the cylinder bore without a great loss in efficiency of compression in the compressor.

In accordance with the present invention, there is provided an axial multi-piston compressor comprising: a drive shaft; a cylinder block having cylinder bores formed therein and surrounding the drive shaft; a plurality of pistons slidably received in the respective cylinder bores; a conversion means for converting a rotational movement of the drive shaft into a reciprocation of each piston in the corresponding cylinder bore such that a suction stroke and a discharge stroke are alternately executed therein, a fluid being introduced into the cylinder bore during the suction stroke, and during the compression stroke, the introduced fluid being compressed and discharged from the cylinder bore such that a residual part of the compressed fluid is inevitably left in the cylinder bore when the compression stroke is finished; and a valve means for allowing the residual fluid to escape from the cylinder bore into another cylinder bore after the suction stroke is executed in the former cylinder bore over a given short period of time.

Preferably, the valve means is constituted such that a high-pressure part of the residual fluid escapes into the cylinder bore governed by the compression stroke, and that a low-pressure part of the residual fluid escapes into the cylinder bore in which the compression stroke is just initiated.

The valve means may comprise a rotary valve joined to the drive shaft to be rotated together therewith and having a groove formed in a peripheral surface thereof, and during the rotation of the rotary valve, a communication between the cylinder bores is established by the groove, whereby the residual part of the compressed fluid can escape from one of the cylinder bores into the other cylinder bore. The groove may be in the form of a closed loop. The rotary valve may include a passage means for introducing the fluid into each of the cylinder bores during the suction stroke. Preferably, the groove and the passage means are diametrically opposed to each other on the peripheral surface of the rotary valve.

BRIEF DESCRIPTION OF THE DRAWINGS

The other objects and advantages of the present invention will be better understood from the following description, with reference to the accompanying drawings, in which.

DESCRIPTION OF THE PREFERRED EMBODIMENTS

Figure 1:
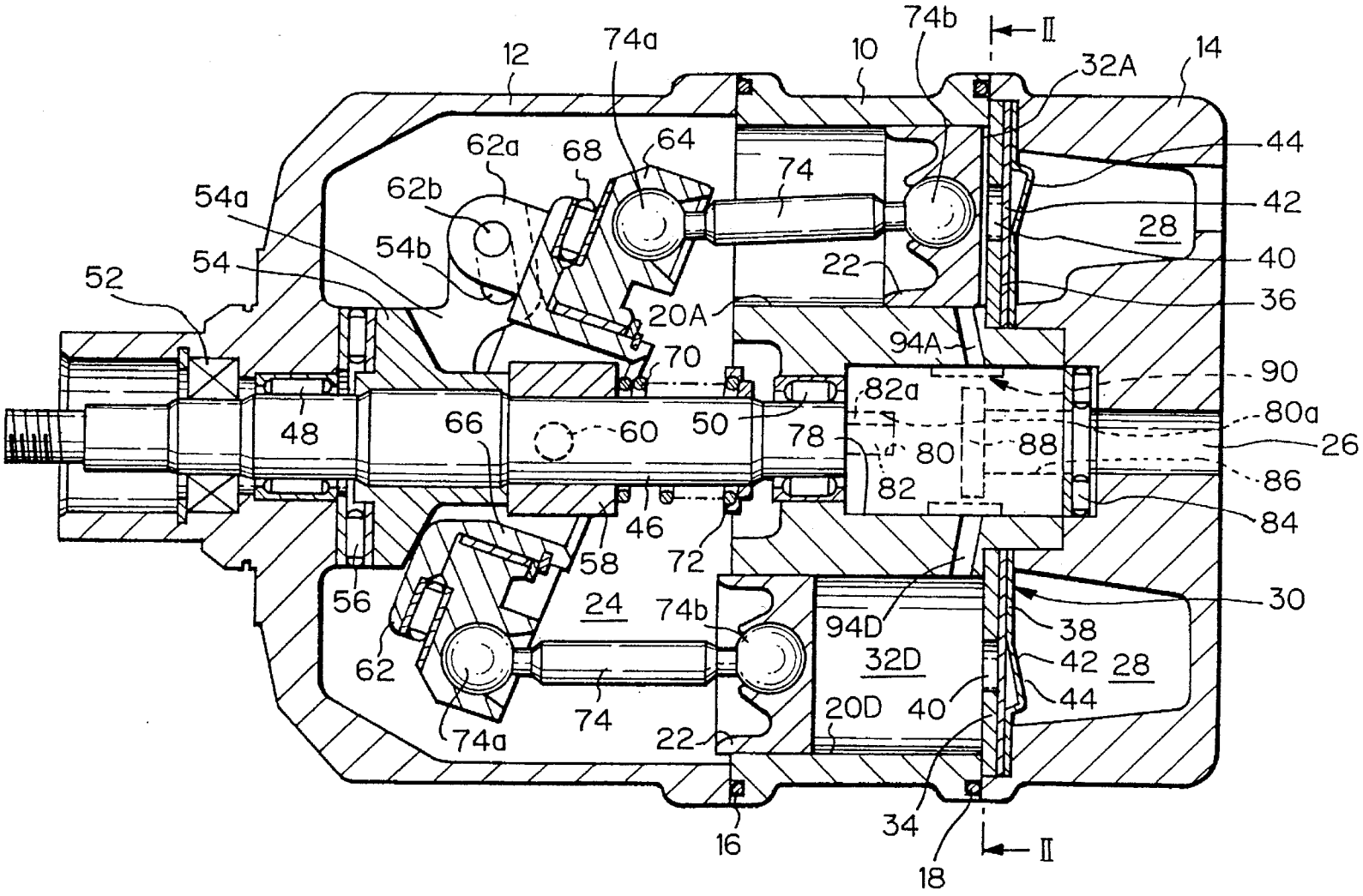
FIG. 1 is a longitudinal sectional view showing a wobble plate type compressor according to the present invention.
Figure 2:
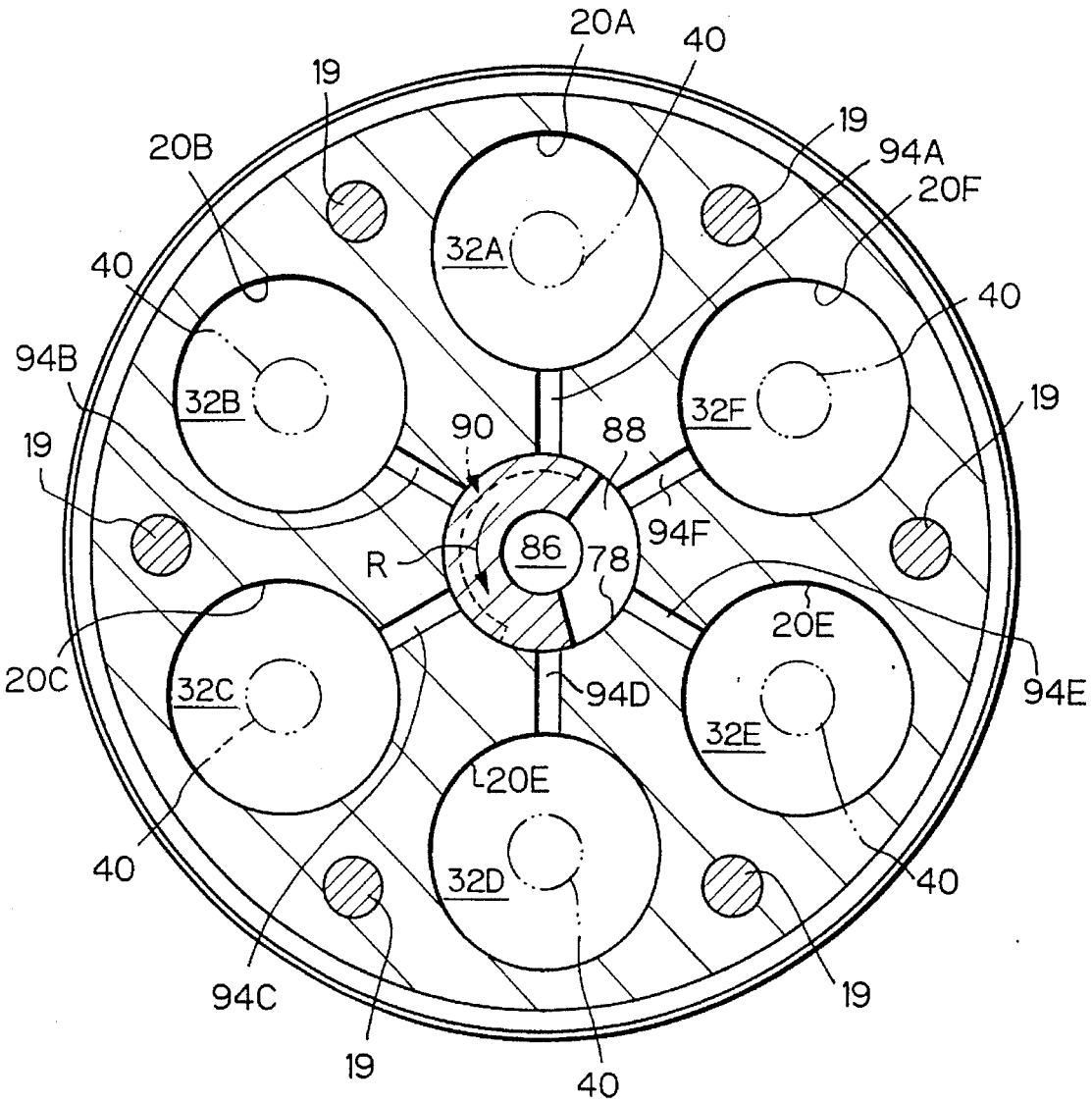
FIG. 2 is a cross-sectional view taken along a line II—II of FIG. 1.

FIG. 1 shows a wobble-plate-type compressor as an axial multi-piston compressor in which the present invention is embodied, and which may be used in an air-conditioning system (not shown) for a vehicle such as an automobile. The compressor comprises a cylinder block 10, front and rear housings 12 and 14 securely and hermetically joined to the cylinder block 10 at front and rear end faces thereof through the intermediary of O-ring rings 16 and 18, respectively. The cylinder block 10 and the housings 12 and 14 are assembled as an integrated unit by six screws 19 (see FIG. 2). In this embodiment, as shown in FIG. 2, the cylinder block 10 has six cylinder bores 20A, 20B, 20C, 20D, 20E, and 20F formed radially and circumferentially therein and spaced from each other at regular intervals, and each of the cylinder bores slidably receives a piston 22. The front housing 12 has a crank chamber 24 defined therewithin, and the rear housing 14 has a central suction chamber 26 and an annular discharge chamber 28 defined therewithin and partitioned by an annular wall portion 14*a* integrally projected from an inner wall of the rear housing 14. In this embodiment, the suction chamber 26 and the discharge chamber 28 are in communication with an evaporator and a condenser of the air-conditioning system, respectively, so that a fluid or refrigerant is supplied from the evaporator to the suction chamber 26 and a compressed refrigerant is delivered from the discharge chamber 28 to the condenser.

A valve plate assembly 30 is disposed between the rear end face of the cylinder block 10 and the rear housing 14, and defines compression chambers 32A, 32B, 32C, 32D, 32E, and 32F together with the heads of the pistons 22 slidably received in the cylinder bores 20A to 20F, as shown in FIG. 2. The valve plate assembly 30 includes a disc-like plate member 34, a reed valve sheet 36 applied to an outer side surface of the disc-like plate member 34, and a retainer plate member 38 applied to an outer side surface of the reed valve sheet 36. The disc-like member 34 may be made of a suitable metal material such as steel, and has six discharge ports 40 formed radially and circumferentially therein and spaced from each other at regular intervals, so that each of the discharge ports 40 is encompassed within an end opening area of the corresponding one of the cylinder bores 20A to 20F. Note, in FIG. 2, each of the discharge ports 40 is illustrated by a phantom line. The reed valve sheet 36 may be made of spring steel, phosphor bronze, or the like, and has six discharge reed valve elements 42 formed integrally therewith and arranged radially and circumferentially to be in register with the discharge ports 40, respectively, whereby each of the discharge reed valve elements 42 can be moved so as to open and close the corresponding discharge port 40, due to a resilient property thereof. The retainer plate member 38 may be made of a suitable metal material such as steel, and is preferably coated with a very thin rubber layer. The retainer plate member 38 has six retainer elements 44 formed integrally therewith and arranged radially and circumferentially to be in register with the discharge reed valve elements 42, respectively. Each of the retainer elements 44 provides a sloped bearing surface for the corresponding one of the discharge reed valve elements 42, so that each discharge reed valve element 42 is Opened only by a given angle defined by the sloped bearing surface of the retainer element 44.

A drive shaft 46 extends within the front housing 12 so that a rotational axis thereof matches a longitudinal axis of the front housing 12, and one end of the drive shaft 46 is projected outside from an opening formed in a neck portion 12*a* of the front housing 10 and is operatively connected to a prime mover of the vehicle for rotation of the drive shaft 46. The drive shaft 46 is rotatably supported by a first radial bearing 48 provided in the opening of the neck portion 12*a* and by a second radial bearing 50 provided in a central passage formed in the cylinder block 10. A rotary seal unit 52 is provided in the opening of the neck portion 12*a* to seal the crank chamber 24 from the outside.

A drive plate member 54 is mounted on the drive shaft 46 so as to be rotated together therewith, and a thrust bearing 56 is disposed between the drive plate member 54 and an inner side wall portion of the front housing 12. Also, a sleeve member 58 is slidably mounted on the drive shaft 46, and has a pair of pin elements 60 projected diametrically therefrom. Note, in FIG. 1, only one pin element 60 is illustrated by a broken line. A cam plate member 62 is swingably supported by the pair of pin elements 60. As apparent from FIG. 1, the cam plate member 62 is in an annular form, and the drive shaft 46 extends through a central opening of the annular cam plate member 62. The drive plate member 54 is provided with an extension 54*a* having an elongated guide slot 54*b* formed therein, and the cam plate member 62 is provided with a bracket portion 62*a* projected integrally therefrom and having a guide pin element 62*b* received in the guide slot 54*b*, whereby the cam plate member 62 can be rotated together with the drive plate member 54, and is swingable about the pair of pin elements 60. A wobble plate member 64 is slidably mounted on an annular portion 66 projected integrally from the cam plate member 62, and a thrust bearing 68 is disposed between the cam plate member 62 and the wobble plate member 64.

The sleeve member 58 is always resiliently pressed against the drive plate member 54 by a compressed coil spring 70 mounted on the drive shaft 46 and constrained between the sleeve member 58 and a ring element 72 securely fixed on the drive shaft 46, and thus the sleeve member 58 is resiliently biased against the drive plate member 54.

To reciprocate the pistons 22 in the cylinder bores 20A to 20F, respectively, the wobble plate member 64 is operatively connected to the pistons 22 through the intermediary of six connecting rods 74 having spherical shoe elements 74*a* and 74*b* formed at ends thereof, and the spherical shoe elements 74*a* and 74*b* of each connecting rod 74 are slidably received in spherical recesses formed in the wobble plate member 64 and the corresponding piston 22, respectively. With this arrangement, when the cam plate member 62 is rotated by the drive shaft 46, the wobble plate member 64 is swung about the pair of pin elements 60, so that each of the pistons 22 are reciprocated in the corresponding cylinder bore 20A, 20B, 20C, 20D, 20E, 20F. The crank chamber 24 can be in communication with the suction chamber 26 and/or the discharge chamber through a suitable control valve (not shown) so that a pressure within the crank chamber 24 is variable, whereby the stroke length of the pistons 22 is adjustable.

As shown in FIGS. 1 and 2, according to the present invention, a rotary valve 76 is slidably disposed in a circular space 78 formed by a part of the central passage of the cylinder block 10. The rotary valve 76 is coupled to the inner end of the drive shaft 46 so as to be rotated together therewith. To this end, as shown in FIG. 1, the rotary valve 76 is provided with a central hole 80 formed in one end face thereof and having a key slot 80*a* extending radially therefrom, and the drive shaft 46 is provided with a stub element 82 projected from the inner end face thereof and having a key 82*a* extending radially therefrom. Namely, the stub element 82 having the key 82*a* is inserted into the central hole 80 having the key slot 80*a*, so that the rotary valve 76 can be rotated together with the drive shaft 46. Note, in FIG. 1, a reference numeral 84 indicates a thrust bearing for the rotary valve 76, which is disposed in a central recess formed in the annular wall portion 14*a* of the rear housing 14.

Figure 3:
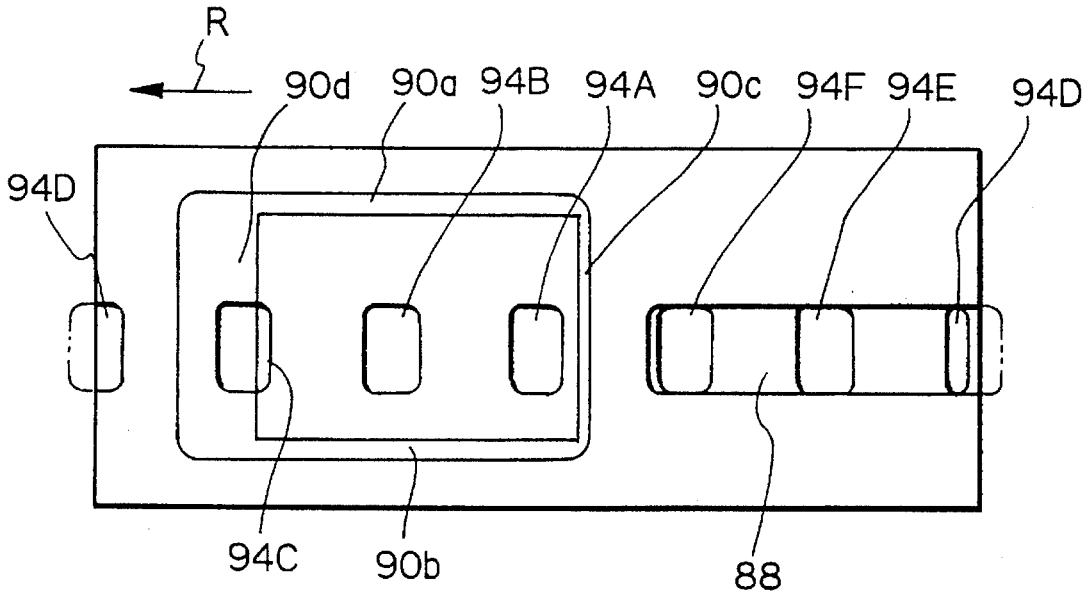
FIG. 3 is a development view showing an outer wall surface of a suction rotary valve and an inner wall surface of a central space formed in a cylinder block of the compressor and slidably receiving the suction rotary valve.

The rotary valve 76 is also provided with a central hole 86 formed therein, and the central hole 86 is opened at the other end face of the rotary valve 76 so as to be in communication with the suction chamber 26 through a central passage of the thrust bearing 84. As best shown in FIG. 2, a sector-shaped groove 88 is formed in the rotary valve 76, and is in communication with the central hole 86. Thus, the sector-shaped groove 88 is in communication with the suction chamber 26 through the central hole 86. The rotary valve 76 is further provided with a closed loop groove 90 formed in a peripheral surface thereof. As is apparent from FIG. 3 in which an outer peripheral wall surface of the rotary valve 76 is shown as a development view, the closed loop groove 90 includes two parallel arcuate groove portions 90*a* and 90*b* coextended circumferentially along the outer peripheral surface of the rotary valve 76, and two side groove portions 90*c* and 90*d* connected between two sets of ends of the parallel arcuate groove portions 92*a* and 92*b*. Note, the width of the side groove portion 90*d* is considerably larger than that of the side groove portion 90*c* for the reasons stated in detail hereinafter. On the other hand, as best shown in FIG. 2, the cylinder block 10 is provided with six radial passages 94A, 94B, 94C, 94D, 94E, and 94F formed therein and extended from the compression chambers 32A to 32F to the circular space 78 of the cylinder block 10, respectively. In FIG. 3, an inner peripheral wall surface of the circular space 78 is also shown in a development view to illustrate a relationship between the rotary valve 76 and the arrangement of the radial passages 94A, 94B, 94C, 94D, 94E, and 94F.

When the rotary valve 76 is rotated by the drive shaft 46 in a direction indicated by an arrow R (FIGS. 2 and 3), the radial passages 94A to 94F successively communicate with the suction chamber 26 through the central hole 86 and the sector-shaped groove 88. Also, during the rotation of the drive shaft 46, the pistons 22 are reciprocated in the cylinder bores 20A to 20F, so that a suction stroke and a compression stroke are alternately executed in each of the cylinder bores 20A to 20F. During the suction stroke, i.e., during movement of the piston 22 concerned from top dead center toward bottom dead center, the refrigerant is introduced from the suction chamber 26 into the corresponding compression chamber 32A, 32B, 32C, 32D, 32E, 32F through the central hole 86, the sector-shaped groove 88, and the corresponding radial passage 94A, 94B, 94C, 94D, 94E, 94F. During the compression stroke, i.e., during a movement of the piston 22 concerned from bottom dead center toward top dead center, the refrigerant is compressed in the corresponding compression chamber 32A, 32B, 32C, 32D, 2E, 32F, and is then discharged therefrom into the discharge chamber 28 through the corresponding reed valve 42.

For example, when the piston 22 received in the cylinder bore 20A reaches top dead center, the rotary valve 76 is at an angular position, as shown in FIG. 3, with respect to the six radial passages 94A, 94B, 94C, 94D, 94E, and 94F. At this point of time, in the cylinder bore 20A or compression chamber 32A, the compression stroke is just finished so that a part of the compressed refrigerant is inevitably left in a small volume of the compression chamber 32A defined by the piston head (22) and the valve plate assembly 30. On the other hand, in the diametrically opposed cylinder bore 20D or compression chamber 32D, the piston 22 reaches bottom dead center, and thus the suction stroke is just finished. Also, each of the cylinder bores 20B and 20C or compression chambers 32B and 32C is subjected to the compression stroke, and each of the cylinder bores 20E and 20F or compression chambers 32E and 32F is subjected to the suction stroke. Note, in the situation shown in FIG. 3, the side groove portion 90*d* of the closed loop groove 90 partially lies over the opening of the radial passage 94C, i.e., the compression chamber 32C is communicated with the closed loop groove 90.

Figure 4:
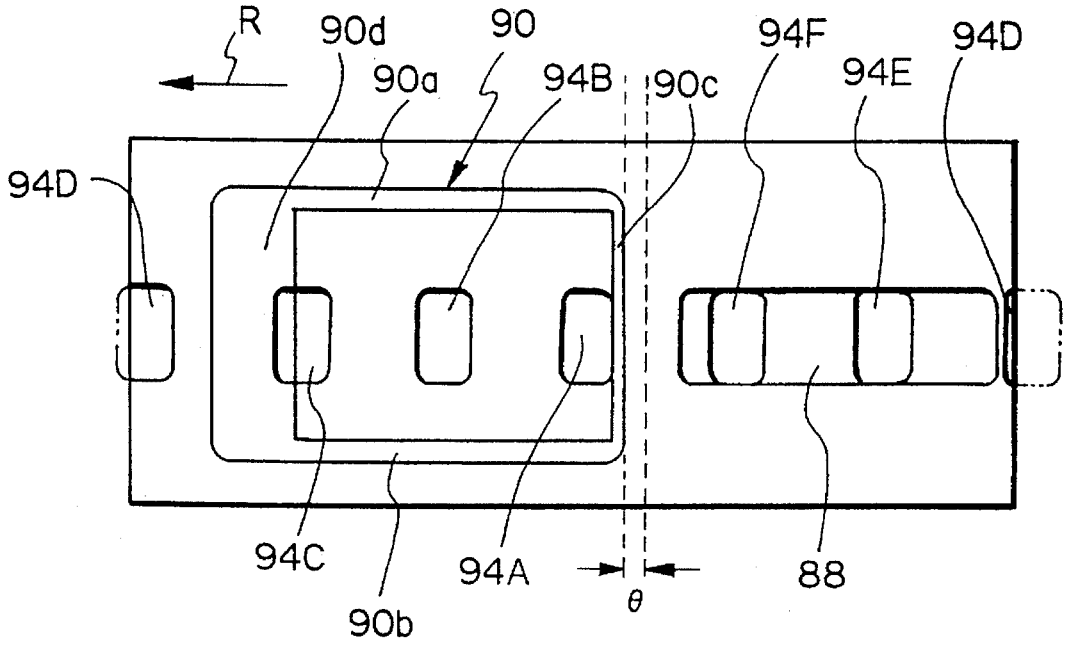
FIG. 4 is a development view similar to FIG. 3, in which the suction rotary valve is rotated from an angular position of FIG. 3 by an angle θ.

When the rotary valve 76 is rotated from the angular position shown in FIG. 3 to an angular position as shown in FIG. 4 by an angle θ of from about 3 to about 6 degrees, the side groove portion 90*c* of the closed loop groove 90 bounds on the opening of the radial passages 94A. During the rotation of the rotary valve 76 by the angle of θ, the piston 22 is somewhat moved from top dead center toward bottom dead center, so that the residual part of the compressed refrigerant is expanded in the small volume of the compression chamber 32A. Accordingly, a drive force for initially moving the piston 22 from top dead center toward bottom dead center is relatively small due to the expansion of the residual refrigerant. Note, in the situation shown in FIG. 4, the communication is still maintained between the radial passage 94C and the closed loop groove 90.

Figure 5:
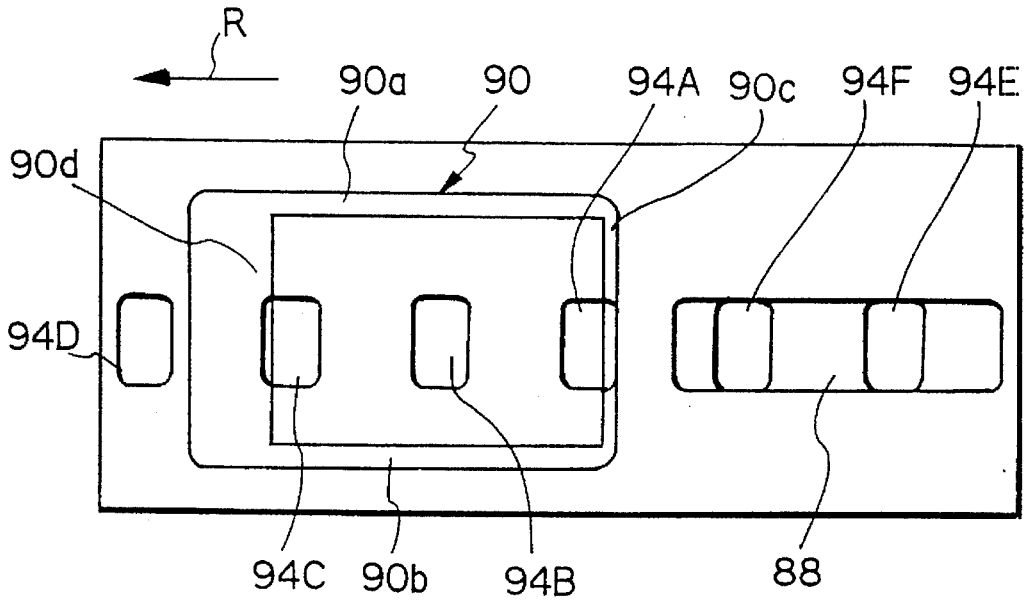
FIG. 5 is a development view similar to FIG. 3, in which the suction rotary valve is further rotated from an angular position of FIG. 4.

When the rotary valve 76 is further rotated from the angular position shown in FIG. 4 to an angular position as shown in FIG. 5, the side groove portion 90*c* of the closed loop groove 90 come over the opening of the radial passage 94A, so that the radial passage 94A is communicated with the side groove portion 90*c* of the closed loop groove 90. On the other hand, the communication is yet still maintained between the radial passage 94C and the closed loop groove 90, and thus the compression chambers 32A and 32C are communicated with each other through the closed loop groove 90, whereby a part of the residual refrigerant escapes from the compression chamber 32A into the compression chamber 32C which is subjected to the compression stroke.

In this case, the escaped part of the residual refrigerant has a relatively high pressure, and can be efficiently re-compressed in the compression chamber 94C.

Figure 6:
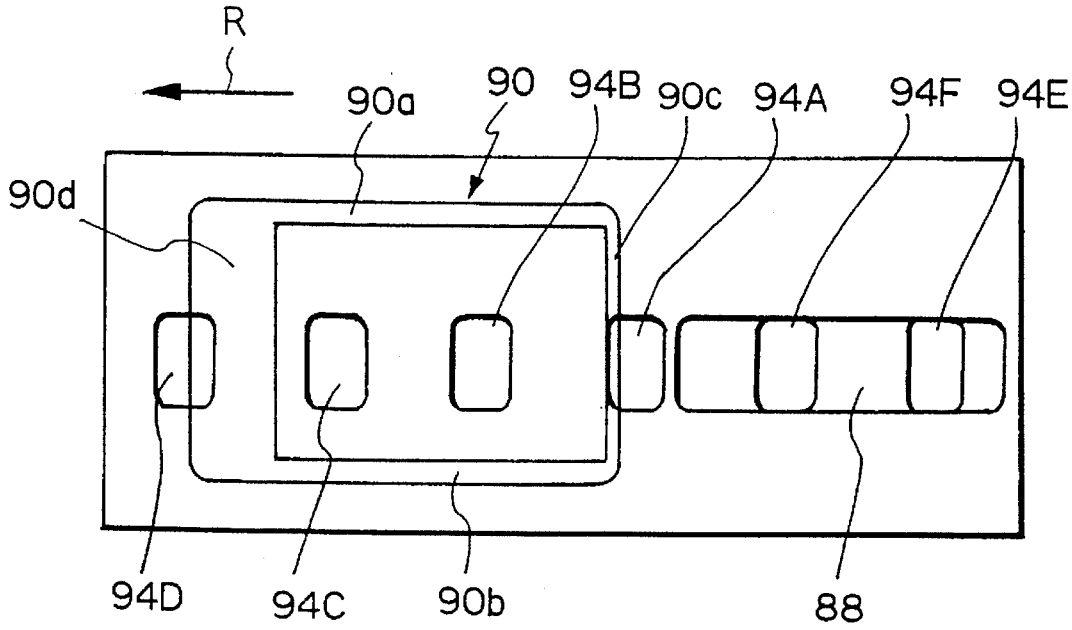
FIG. 6 is a development view similar to FIG. 3, in which the suction rotary valve is further rotated from an angular position of FIG. 5.

When the rotary valve 76 is further rotated from the angular position shown in FIG. 5 to an angular position as shown in FIG. 6, the communication is cut off between the radial passage 94C and the closed loop groove 90, and the side groove portion 90*d* of the closed loop groove 90 comes over the opening of the radial passage 94D so that a communication is established between the radial passage 94D and the closed loop groove 90. On the other hand, the communication is still maintained between the radial passage 94A and the closed loop groove 90. Accordingly, the compression chambers 94A and 94D are communicated with each other through the closed loop groove 90, so that another part of the residual refrigerant escapes from the compression chamber 94A into the compression chamber 94D in which the compression stroke is just initiated. In this case, although the escaped part of the residual refrigerant has a lower pressure than that of the above-mentioned escaped part thereof, a suction volume of the refrigerant can increase in the compression chamber 94C, resulting in an improvement of performance of the compressor.

Just after the side groove portion 90*c* of the closed loop groove 90 passes through the opening of the radial passage 94A, the sector-shaped groove 88 is made to communicate with the radial passage 94A, and thus the refrigerant can be immediately introduced from the suction chamber 26 into the compression chamber 32A due to the escape of the residual refrigerant therefrom. The introduction of the refrigerant into the compression chamber 32A is maintained until the sector-shaped groove 88 passes through the opening of the radial passage 94A.

Figure 7:
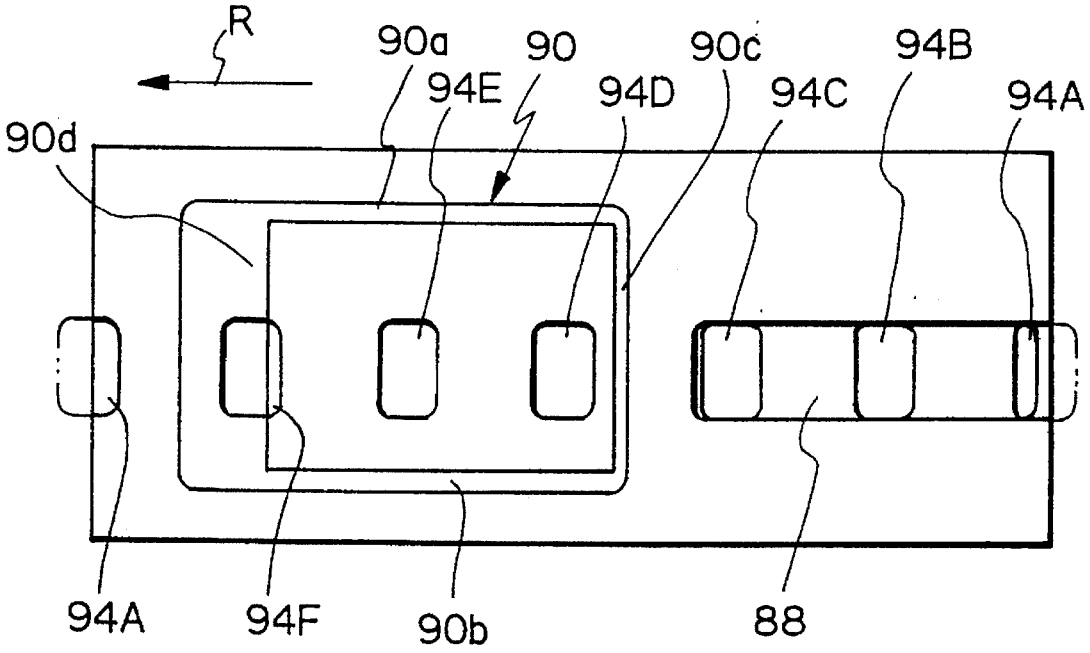
FIG. 7 is a development view similar to FIG. 3, in which the suction rotary valve is further rotated from an angular position of FIG. 6.

Just after the sector-shaped groove 88 passes through the opening of the radial passage 94A, the piston 22 received in the cylinder bore 20A reaches bottom dead center, and the suction stroke is just finished therein. At this point of time, the rotary valve 76 has been rotated over an angle of 180 degrees measured from the angular position of FIG. 3, and is at an angular position as shown in FIG. 7. This situation is equivalent to that of FIG. 3. Namely, in the diametrically opposed cylinder bore 20D, the piston 22 reaches top dead center. Accordingly, when the rotary valve 76 is further rotated over an angle of 180 degrees measured from the angular position of FIG. 7, the piston 22 received in the cylinder bore 20A again reaches top dead center, and this situation is identical with that shown in FIG. 3. During the rotation of the rotary valve 76 from the angular position of FIG. 7 to the original angular position of FIG. 3, i.e., during the movement of the piston 22 from bottom dead center to top dead center in the cylinder bore 20A, the compression chamber 32A is supplied with an additional part of refrigerant escaped from each of the compression chambers 94D and 94E, as is apparent from the descriptions referred to FIGS. 5 and 6.

Figure 8:
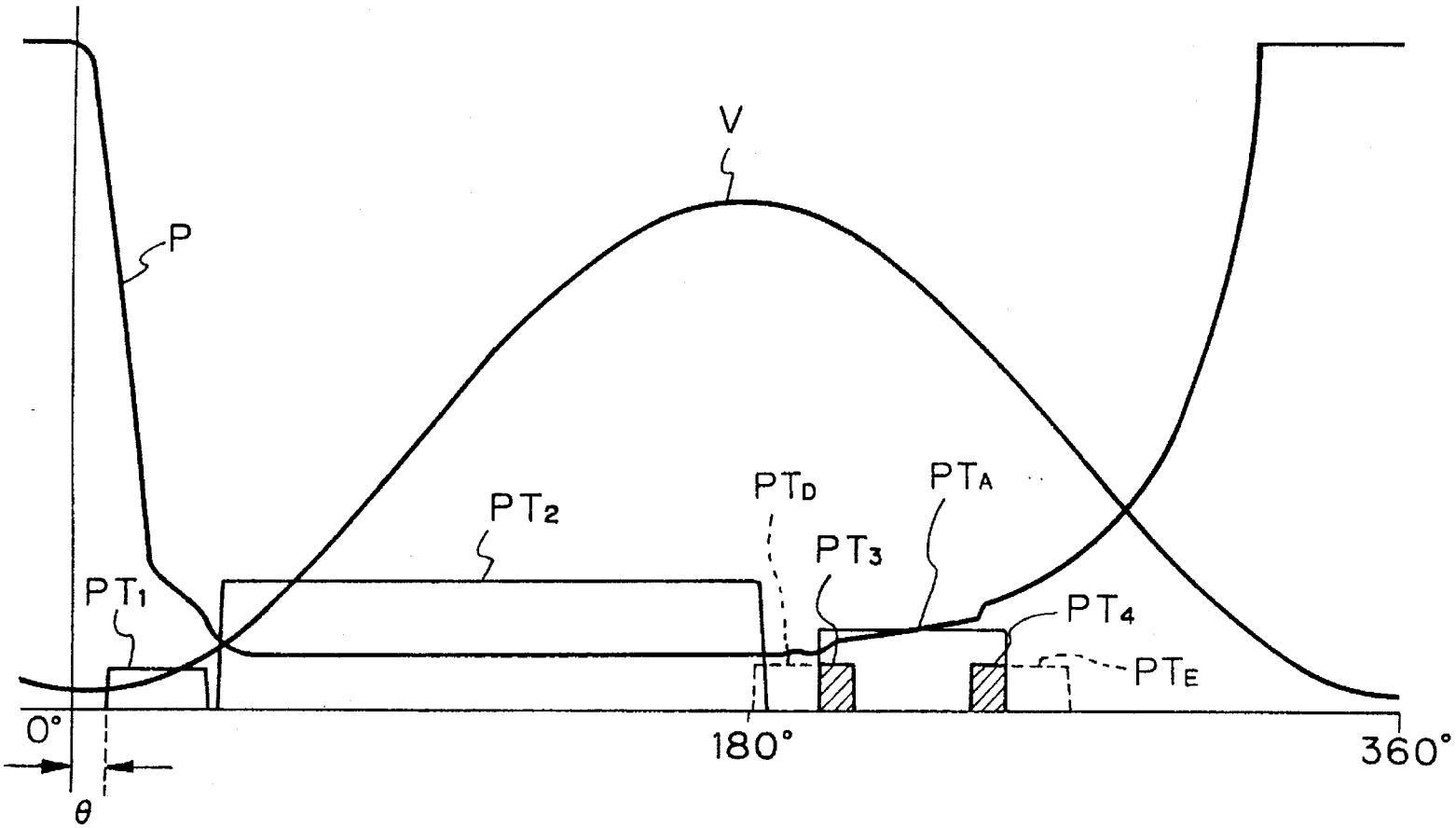
FIG. 8 is a graph showing a variation of pressure in a compression chamber and a variation of volume thereof when rotating the suction rotary valve over an angle of 360 degrees.

FIG. 8 is a graph showing a variation of pressure in the compression chamber 32A, represented by a curve P, and a variation of volume of the compression chamber 32A, represented by a curve V, when rotating the rotary valve 76 over an angle of 360 degrees. In this graph, it is assumed that a rotational angle of the rotary valve 76 is zero when the piston 22 is at top dead center in the cylinder bore 20A (FIG. 3).

When the rotational angle of the rotary valve 76 is zero, the pressure P in the compression chamber 32A is maximum, and the volume V thereof is minimum. When the rotary valve 76 is rotated by the angle θ, the piston 22 is correspondingly moved from top dead center toward bottom dead center so that the volume V is somewhat increased, and thus the residual refrigerant is expanded so that the pressure P is gradually lowered.

When the rotational angle of the rotary valve 76 exceeds the angle θ, the side groove portion 90*c* of the closed loop groove 90 comes over the opening of the radial passage 94A so that the communication is established between the compression chamber 32A and the closed loop groove 90. In the graph of FIG. 8, reference $PT_1$ indicates a period of time over which the communication is maintained between the compression chamber 32A and the closed loop groove 90. At the beginning of the period $PT_1$, the compression chambers 32A and 32C communicate with each other (FIG. 5), and thus the high-pressure part of the residual refrigerant is fed from the compression chamber 32A to the compression chamber 32C, so that the pressure P is rapidly lowered. At the ending of the period of time $PT_1$, the compression chambers 32A and 32D communicate with each other (FIG. 6), and thus the low-pressure part of the residual refrigerant is fed from the compression chamber 32A to the compression chamber 32D, so that the pressure P is gradually lowered.

Just after the communication is cut off between the compression chambers 32A and 32D, the compression chamber 32A communicates with the suction chamber 26 through the central hole 86, the sector-shaped groove 88, and the radial passage 94A. In the graph of FIG. 8, reference $PT_2$ indicates a period of time over which the communication is maintained between the compression chamber 32A and the suction chamber 26, and the suction stroke is executed over the period of time $PT_2$. During the suction stroke, the pressure P is kept constant, and the volume V of the compression chamber 94A reaches a maximum peak at the ending of the suction stroke.

Just after the suction stroke is finished, i.e., just after the compression stroke is initiated, the compression chamber 94A is supplied with the low-pressure part of the refrigerant that escaped from the compression chamber 94D. This period of time is indicated by reference $PT_3$, and the pressure P is increased due to the supply of the low-pressure part of refrigerant. Successively, the compression chamber 94A is supplied with the high-pressure part of refrigerant escaped from the compression chamber 94E. This period of time is indicated by reference $PT_4$, and the pressure P is also increased due to the supply of the high-pressure part of refrigerant. Note, in the graph of FIG. 8, reference $PT_A$ indicates a period of time over which the radial groove 94A communicates with the side groove portion 90*d* of the closed loop groove 90, reference $PT_D$ indicates a period of time over which the radial groove 94D communicates with the side groove portion 90*c* of the closed loop groove 90, and reference $PT_E$ indicates a period of time over which the radial groove 94E communicates with the side groove portion 90*c* of the closed loop groove 90.

Thereafter, the pressure P is rapidly increased in response to a decrease in the volume V of the compression chamber 32A, shown in the graph of FIG. 8. When the pressure P reaches the maximum value, the discharge reed valve is opened so that the compressed refrigerant is discharged from the compression chamber 32A into the discharge chamber 28, and thus the maximum value of the pressure P is kept constant.

Note, although only the cylinder bore 20A or compression chamber 32A has been referred to in the above-description, the same is true for other compression chambers 32B, 32C, 32D, 32E, 32F.

Also, in the embodiment described, although the present invention is applied to a wobble plate type compressor as an axial multi-piston compressor, the present invention may be embodied in another type axial multi-piston compressor.

Finally, it will be understood by those skilled in the art that the foregoing description is of a preferred embodiment of the disclosed compressor, and that various changes and modifications may be made to the present invention without departing from the spirit and scope thereof.

We claim:

1. An axial multi-piston compressor comprising:

a drive shaft;

a cylinder block having cylinder bores formed therein and surrounding said drive shaft;

a plurality of pistons slidably received in the respective cylinder bores;

a conversion means for converting a rotational movement of said shaft into a reciprocation of each piston in the corresponding cylinder bore such that a suction stroke and a discharge stroke are alternately executed therein, a fluid being introduced into said cylinder bore during the suction stroke, and during the compression stroke, the introduced fluid being compressed and discharged from said cylinder bore so that a residual part of the compressed fluid remains in said cylinder bore when the compression stroke is finished; and a valve means for allowing the residual fluid to escape from said cylinder bore a predetermined time after the suction stroke is initiated in the cylinder bore into a second cylinder bore, and wherein said valve means comprises a rotary valve joined to said drive shaft to be rotated together therewith and having a groove in the form of a closed loop formed in a peripheral surface thereof, and during the rotation of said rotary valve, a communication between the cylinder bores is established by said groove.

2. An axial multi-piston compressor as set forth in claim 1, wherein said valve means is constituted such that a high-pressure part of the residual fluid escapes into said second cylinder bore which is governed by the compression stroke.

3. An axial multi-piston compressor as set forth in claim 2, wherein said valve means is constituted such that a low-pressure part of the residual fluid escapes into a third cylinder bore in which the compression stroke is just initiated.

4. An axial multi-piston compressor as set forth in claim 1, wherein said rotary valve includes a passage means for introducing the fluid into each of the cylinder bores during the suction stroke.

5. An axial multi-piston compressor as set forth in claim 4, wherein said groove and said passage means are diametrically opposed to each other on the peripheral surface of said rotary valve.

* * * * *